United States Patent [19]

Doyen et al.

[11] 3,935,993

[45] Feb. 3, 1976

[54] FREE-STANDING CONTAINER

[76] Inventors: Leon Doyen; Louis Doyen, both of 79, rue de Bourgogne, Lyon 9 (Rhone), France

[22] Filed: Jan. 21, 1974

[21] Appl. No.: 435,095

[30] Foreign Application Priority Data

Jan. 26, 1973 France ..... 73.03616

[52] U.S. Cl. ..... 229/53; 229/58

[51] Int. Cl.[2] ..... B65D 11/02; B65D 11/10; B65D 11/22

[58] Field of Search ..... 229/57, 58, 53, 61

[56] References Cited

UNITED STATES PATENTS

| | | | |
|---|---|---|---|
| 1,240,564 | 9/1917 | Harrongton | 229/57 X |
| 2,599,567 | 6/1952 | McCreary et al. | 229/57 |
| 3,380,646 | 4/1968 | Doyen et al. | 229/57 |
| 3,437,258 | 4/1969 | Kugler | 229/58 |
| 3,478,952 | 11/1969 | Perlman | 229/57 |

FOREIGN PATENTS OR APPLICATIONS

| | | | |
|---|---|---|---|
| 46-5979 | 11/1967 | Japan | 229/57 |
| 708,367 | 1966 | Italy | 229/57 |

*Primary Examiner*—J. M. Meister
*Assistant Examiner*—Leon Gilden
*Attorney, Agent, or Firm*—Karl F. Ross; Herbert Dubno

[57] ABSTRACT

A free-standing container has a pair of like coextensive and outwardly convex side walls whose opposite lateral edges are heat-sealed together along straight seams to form an upright tube whose top and bottom are closed by respective upper and lower end walls each formed with a fold extending between the lateral edges of the side walls and each having a periphery subdivided into a pair of like sections by the respective fold line. Each section is joined to a respective side panel along a nonstraight seam line. This seam may be curved, in which case the end wall panels have circular or oval shape, or may be formed of a plurality of longitudinally joined straight sections in which case the end wall has a polygonal shape. The wall panels are all formed of a thermoplastic synthetic resin.

10 Claims, 14 Drawing Figures

FREE-STANDING CONTAINER

FIELD OF THE INVENTION

The present invention relates to a free-standing container.

BACKGROUND OF THE INVENTION

There is known a container having a pair of like joined-together side wall panels and a sole end panel bridging the two side panels and constituting the bottom wall of the container. This bottom wall lies generally transverse to the two side panels and the top of the container is closed by simply heat sealing together the side panels along their two upper edges. Thus the container is indeed relatively inexpensive to manufacture and quite sturdy. It can be folded flat and is readily filled.

The principal disadvantage of such a container is that it is impossible to use it for large and/or heavy loads. If any of the wall panels are made sufficiently rigid to support the heavy load it is virtually impossible to fold the container flat. Another disadvantage is that the conical or frustoconical shape of the container gives it a limited volume relative to the floor space it occupies. Another disadvantage in the manufacture and filling of such containers is a complicated and frequently expensive process.

OBJECTS OF THE INVENTION

It is therefore an object of the present invention to provide an improved container.

Another object of this invention is the provision of a free-standing container which overcomes the above-given disadvantages.

SUMMARY OF THE INVENTION

These objects are attained according to the present invention in a container formed entirely of thermoplastic synthetic resin sheet material and having two coextensive side panels and two like opposite end panels. The side walls have opposite parallel edges which are heat-sealed together to form a tube. The end panels are similarly identical to each other and each has a central fold subdividing its periphery into a pair of regions each joined to a respective side panel along a respective nonstraight seam. The seams are either curved or formed of a plurality of longitudinally joined straight line sections, the seam extends the full width of a respective side panel, between the lateral edges thereof. The seams both at the lateral edges of the side wall panels and at the nonstraight seams between the end wall panels and the side wall panels are all heat sealed.

The container so formed is symmetrical about a plane passing through the two fold lines in the two end wall panels. The container is therefore of uniform cross-sectional shape from its bottom to its top, and can be made of a stiff and relatively inflexible sheet material so that the container formed thereby can accommodate a relatively heavy load. Such a container is ideally suited for the storage and shipment of liquids such as milk, motor oil and the like, although it is possible to use it for fluent solids such as sand or grain.

In accordance with a further feature of this invention such containers are formed serially from a continuous tube of synthetic-resin material, such as polyethylene. This tube is of uniform cross section and is formed on its opposite longitudinal sides with inward folds. The tube is heat sealed along two transverse parallel lines which constitute the lateral edges of the side walls, and is heat sealed in the regions of the folds along nonstraight lines so as to form the end panels. These last-mentioned heat seals are nonstraight so that, when the container is filled, the fold opens out and allows a fluid to be introduced into the cavity between the side walls, thereby bulging same and giving them an outwardly convex shape. Thus one of the end walls constitutes the top of the container, the other end wall constitutes the bottom thereof.

According to a further feature of the present invention each end wall is generally lozenge shaped so that the seams between the periphery of this end wall and the side walls are curved. It is also within the scope of this invention to have polygonal end walls, in which case nonstraight seams between the end walls and the side walls are each formed of several longitudinally joined straight line sections.

According to another feature of the invention such containers are produced and filled continuously by leaving one of the seams partially open and injecting into the bags a fluid such as milk, and thereafter sealing the gap left in the seam in a subsequent operation. In this manner it is possible to produce a continuous series of filled bags. Since the side walls need only assume an arcuate shape, or fold along one or more lines, it is possible to make them of relatively rigid synthetic-resin material. Thus the container can accommodate relatively heavy loads without rupturing.

In other words, the container is made from a tube having edges which are W-shaped seen in transverse cross section. This tube therefore is formed at its longitudinal edges with an inward fold having a pair of flaps. A pair of longitudinally spaced heat-seal seams first define a region along the tube, then nonstraight heat-seal seams are formed extending between these transverse seams, each such nonstraight seam attaching a respective flap of a fold to a respective face of the tube. These seams together form a cavity which is filled with a liquid or fluent solid preferably before the tube is longitudinally subdivided into separate containers.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
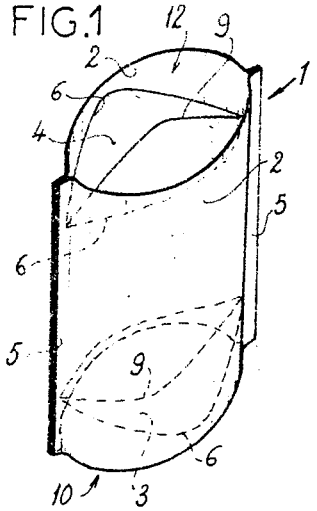
FIGS. 1, 2 and 3 are perspective, longitudinal sectional and cross-sectional views of a container according to the present invention.
Figure 2:
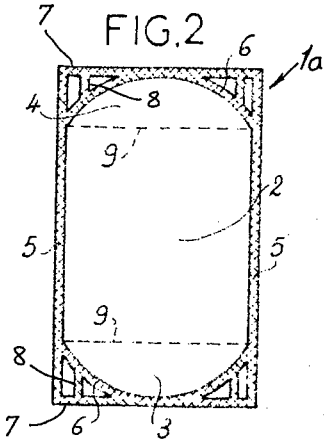
Figure 3:
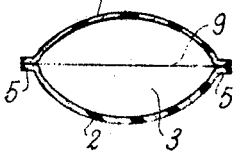

FIGS. 1 – 3 show the container 1 having a pair of light side walls 2 of rectangular shape and like end walls 3 and 4, the former being a bottom wall and the latter being a top wall, both being of generally elliptical shape. The side walls are joined together at seams 5 at their parallel lateral edges. Circularly arcuate seams 6 which are inwardly concave join the top wall 4 and the bottom wall 3 to the side wall 2, these seams 6 being heat seal, extending between the two edges 5. Each of the end walls 3 and 4 is formed with traverse straight folds 9 which each extend from one of the edges 5 to the other and bisects the respective end wall 3, 4 into two like halves. Thus there is formed at the bottom of the container a recess 10 and at the top of the container a recess 12, both being outwardly open and being defined by the respective end wall 3, 4 and by that portion of the side walls 2 which project beyond the seam 6. It should be noted that further seams 7 and 8 are provided to reinforce the container. Such a container is very stable when stood on its end 3 as shown in FIG. 1. It can be filled with a liquid or a fluent solid readily and forms a very rugged receptacle. The walls 2, 3, and 4 are all formed of polyethylene which is readily thermally welded and inexpensive.

Figure 4:
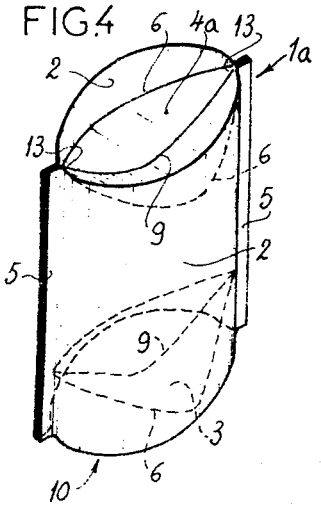
FIGS. 4 and 5 are views corresponding to FIGS. 1 and 2 showing another container in accordance with this invention.
Figure 5:
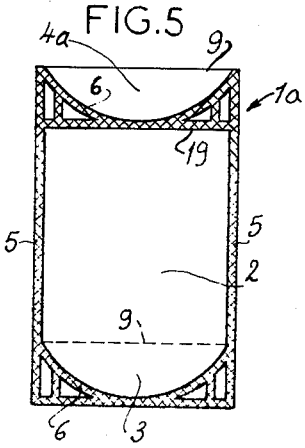

FIGS. 4 and 5 show a container 1*e* which is identical to the container 1 of FIGS. 1 – 3 with the exception that the upper end wall 4 is inwardly convex and outwardly concave, that is opposite to the wall 4 of the container 1 of FIGS. 1 through 3. This container is of slightly less volumetric capacity than the container of FIGS. 1 through 3, but has the advantage that removal of one of its corners 13 allows the contents to be poured readily. This corner 13 represents the junction between fold line 9, seam 6 and side seam 5, and is the upper corner of the container 1*a*. In addition this upper wall of 4*a* is reinforced through extra seams 19, which do not materially reduce the volumetric capacity of the container 1*a*, but which rigidify it substantially.

Figure 6:
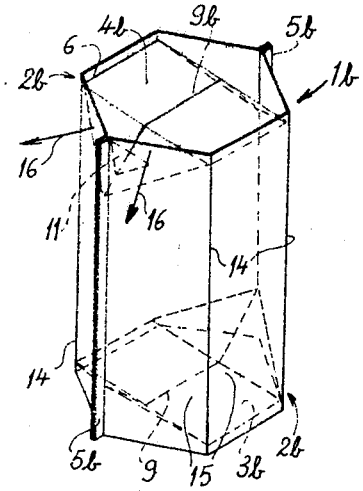
FIGS. 6, 7 and 8 are views corresponding to FIGS. 1, 2 and 3 showing yet another container in accordance with the present invention.
Figure 7:
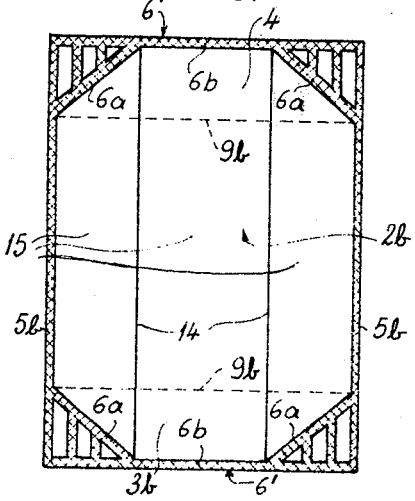
Figure 8:
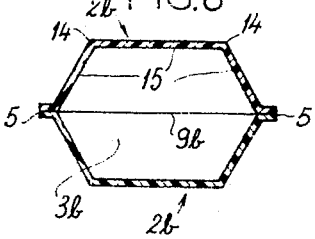
Figure 9:
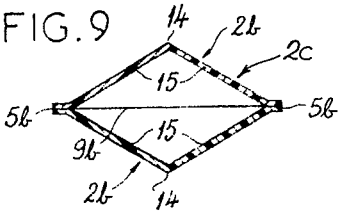
FIGS. 9 and 10 are cross-sectional views through another two types of containers of the invention.
Figure 10:
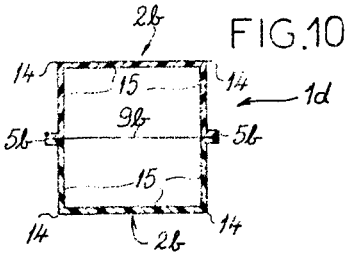

FIGS. 6 to 8 show a container 1*b* which is substantially identical to the container of FIGS. 1 through 3 except that it has side walls 2*b* each formed with two parallel fold lines 14 extending parallel to its edges 5*b* and subdividing each of the side walls into three facets 15. This arrangement is advantageous in that when the upper edges of the container 1*b* are pulled outwardly as indicated by arrows 16, and a region 11 is punched out it is possible to pour liquid from this container 1*b* pitcher-fashion. This container 1*b* is particularly suited for the distribution of milk and the like. FIG. 7 indicates how each of the seam lines 6 is subdivided into sections 6*a* extending at substantially 45° to the edges 5 and creases 14 and a central section 6*b* extending at a right angle to these regions. Their hexagonal shape, although it is possible to employ either a rhombus shape as shown in container 1*c* of FIG. 9 or a square shape as shown in container 1*d* of FIG. 10, makes for a very rigid container. Indeed, the only place in which these containers 1*b*, 1*c*, and 1*d* need to bend is at the creases 14, seams 5*b*, 6*a*, and 6*b*, and at fold lines 9*b*.

Figure 11:
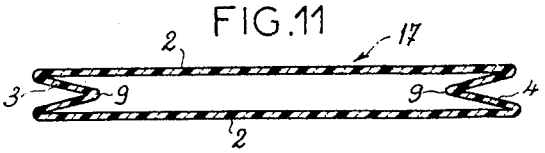
FIG. 11 is a cross section through tube used to produce the container of FIGS. 1 through 3.
Figure 12:
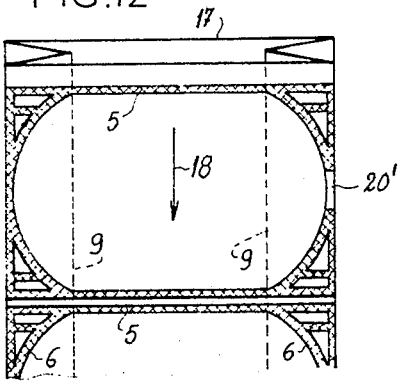
FIGS. 12 and 13 are longitudinal sections through unfilled containers according to the present invention.
Figure 14:
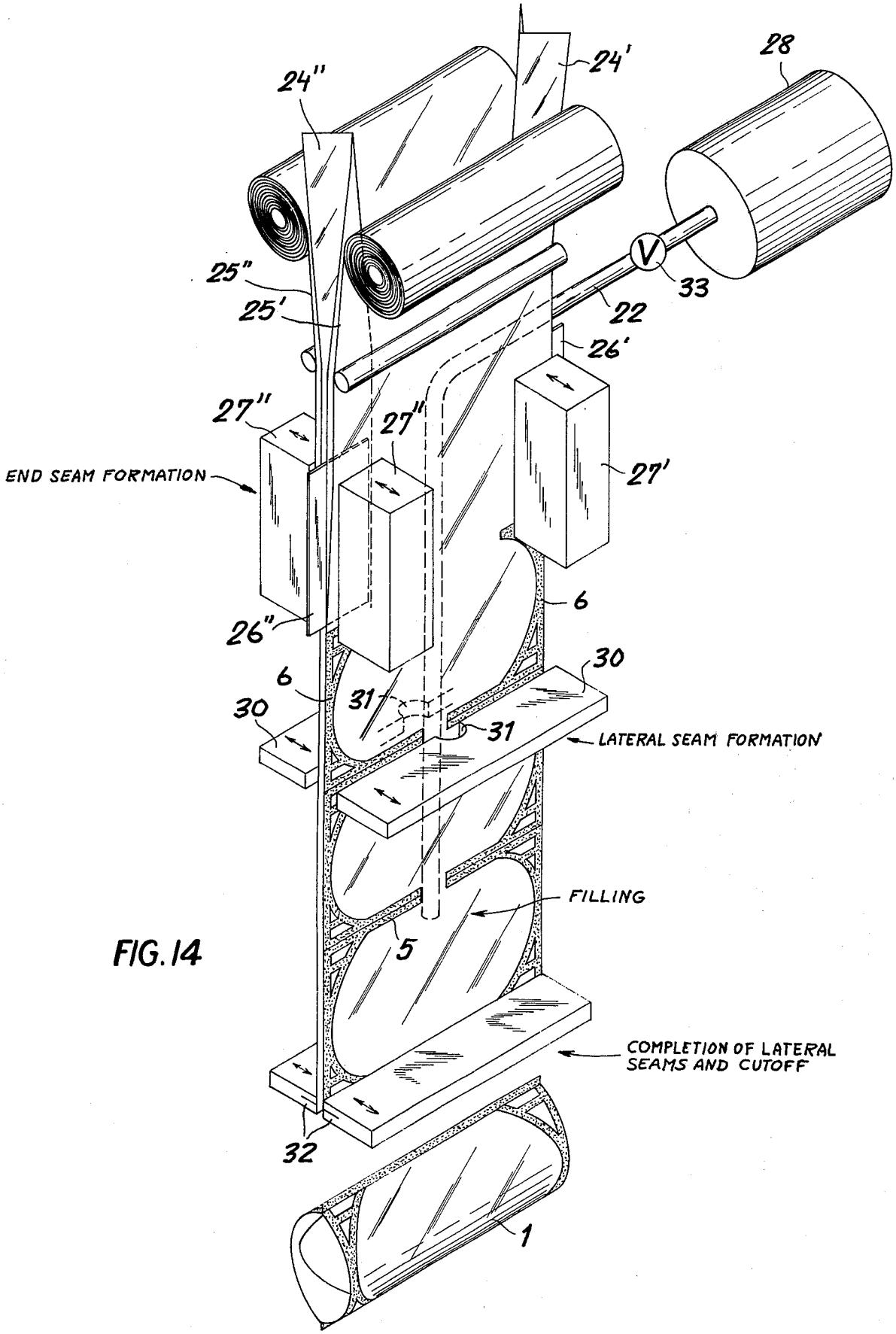
FIG. 14 is a perspective view in partially diagrammatic form illustrating the steps of forming, filling, and separating the containers.

FIG. 11 is a cros section through the tube 17 used to form the containers 1 shown in FIGS. 1 through 3. This tube 17 is heat sealed so that it has seams 5 – 8 as shown in FIGS. 1, 2 and 3 and may be provided at one of the seams 6 with a gap 20′ allowing as shown in FIG. 12 for filling of the containers. Alternately it may be formed as four pieces as shown in FIG. 14, two gusset-forming strips 24′ and 24″ and two side-forming strips 25′ and 25″ each coming from separate rolls, somewhat as described in U.S. Pat. No. 3,380,646 on April 30, 1968. The two gusset-forming sheets 24′ and 24″ are folded over by plates 26′ and 26″ which insert them and hold them in place between the sheets 25′ and 25″ at the longitudinal edges thereof, thereby forming a pair of flaps each juxtaposed to one side of each plate with a single side panel member 25′ or 25″.

Figure 13:
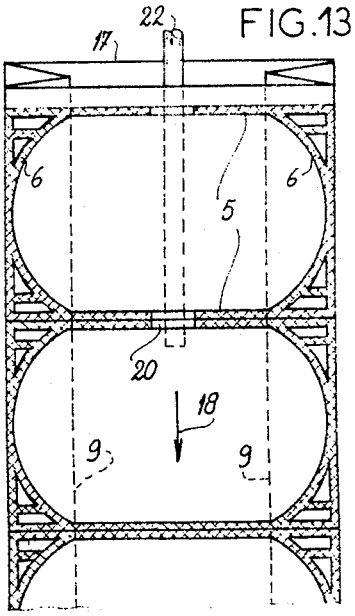

To either side of the plates 26′ and 26″ there are provided guides 27′ and 27″ which are heated and formed with ridges corresponding to the shape of the seams 6, 7 and 8. A supply 28 of milk has a valved outlet tube 22 extending down through the tube 17 and lying between the sheets 25′ and 25″. Downstream of dies 27′ and 27″ there is provided a pair of dies 30 which are formed centrally with notches 31 which the tube 22 passes through and which forms gap 20 in side seams 5, as also shown in FIG. 13. Tube 22 terminates downstream of the dies 30 and upstream of another pair of dies 32 formed so as to complete the lateral seams 5, thereby closing the gap 20, also serving to subdivide the tube longitudinally by cutting across the tube at the seam 5 thereby separating the tube into individual containers 1. In step with the die pair 32 a valve 33 of tube 22 is actuated to introduce a quantity of liquid into the cavity between the lateral seams 5. Thus in one continuous operation four sheets are united into a single tube 17 as shown in FIG. 11, the cavities in this tube are automatically filled, and the tube is subdivided into separate containers.

A container according to the present invention can therefore be made rapidly and inexpensively. It is nonetheless extremely rigid and can carry relatively heavy loads. Relative to the floor space such a container occupies, it holds a large quantity of material so that such a container is an extremely efficient package.

We claim:

1. A free-standing container comprising:

a pair of like coextensive, rectangular and outwardly convex side wall panels having rectilinear opposite parallel longitudinal edges seamed together by heat seals all along said edges;

a pair of like end wall panels each having a periphery and each formed with a fold extending between the seamed lateral edges and subdividing the periphery into a pair of like sections, all of said panels being formed of a thermoplastic synthetic resin; and respective nonstraight seams of heat seals joining each of said sections to a respective side panel and extending between its lateral edges, one of said end wall panels constituting the bottom of said container and the other end wall panel constituting the cover thereof.

2. The container defined in claim 1 wherein said nonstraight seams are arcuate.

3. The container defined in claim 2 wherein said nonstraight seams are inwardly concave and said sections are arcuate.

4. The container defined in claim 1 wherein said nonstraight seams are each formed of a plurality of rectilinear sections and each of said end walls is polygonal.

5. The container defined in claim 4 wherein said side wall panels are rectangular and are formed with fold lines parallel to their lateral edges.

6. The container defined in claim 2 wherein the upper and lower arcuate seams both have their concavities turned toward the interior.

7. The container defined in claim 2 wherein the lower arcuate seam has its concavity turned toward the interior and the upper arcuate seam has the concavity turned toward the exterior.

8. A free-standing container comprising a pair of vertically elongated coextensive synthetic resin foil rectangular side panels with adjoining opposite longitudinal edges; a pair of heat-seal seams joining corresponding longitudinal edges of said side panels all along said edges; a pair of identical end panels bridging said said panel at opposite ends of the container and including a lower end panel and an upper end panel of synthetic resin foil respectively, said end panels being each formed with a fold lying in the plane of said heat seal seams inwardly of the upper and lower ends of said side panels; respective end heat seal seams joining the upper and lower edges of each side panel to a respective edge of the respective end panels; a curvilinear heat-seal seam extending from the junction of each fold with the opposite edges of said side panels between each end panel and a respective side panel; and heat seals securing said end panels in the heat-seal seams along the longitudinal edges to said side panels between said folds and the respective end of the container.

9. The container defined in claim 8 wherein said curvilinear seams are convex in opposite directions.

10. The container defined in claim 8 wherein said curvilinear heat seal seams are convex in the same direction.

* * * * *